United States Patent [19]

Chadshay

[11] 4,356,975

[45] Nov. 2, 1982

[54] NOZZLE TIP FOR PULVERIZED COAL BURNER

[75] Inventor: Roman Chadshay, Windsor, Conn.

[73] Assignee: Combustion Engineering, Inc., Windsor, Conn.

[21] Appl. No.: 128,204

[22] Filed: Mar. 7, 1980

[51] Int. Cl.[3] ..... F23D 13/36

[52] U.S. Cl. ..... 239/419.5; 239/424.5; 239/553.5; 239/590.5

[58] Field of Search ..... 239/419.5, 423, 424, 239/424.5, 552, 553, 553.5, 590, 590.5; 122/333

[56] References Cited

U.S. PATENT DOCUMENTS 2,895,435 7/1959 Bogot et al. ..... 239/419.5 X 3,823,875 7/1974 Bauer et al. ..... 239/419.5 X

*Primary Examiner*—John J. Love

*Assistant Examiner*—Gene A. Church

*Attorney, Agent, or Firm*—William W. Habelt

[57] ABSTRACT

An improved nozzle tip (10) for a pulverized coal-fired burner having one or more splitter plates (20) disposed therein. Each splitter plate (20) is formed of a first portion (22) of highly abrasion resistant material disposed at the inlet end of the nozzle tip (10) and a second portion (24) of highly heat resistant material disposed at the outlet end of the nozzle tip (10).

8 Claims, 2 Drawing Figures

NOZZLE TIP FOR PULVERIZED COAL BURNER

BACKGROUND OF THE INVENTION

The present invention relates to burner nozzle tips adapted for use on pulverized coal-fired furnaces and, more particularly, to tilting nozzle tips for burners on pulverized coal-fired furnaces utilizing tangential firing.

One common method of firing coal in conventional coal-fired steam generating boiler furnaces is known as tangential firing. In this method pulverized coal is introduced into the furnace in a primary air stream through burners, frequently termed fuel-air admission assemblies, located in the corner windboxes of the furnace. The pulverized coal-air streams discharging from these burners are aimed tangentially to an imaginary circle in the middle of the furnace to create a massive flame therein termed a fireball.

Upon leaving the furnace proper, the combustion products formed in the fireball pass through a boiler section typically housing a superheater, a reheater, and other various heat absorption surface to cool the combustion products and generate superheated steam. By changing the position of the fireball formed in the furnace upon convergence of the fuel-air streams emanating from the burners, control of the temperature of the steam leaving the superheater or reheater is achieved. By tilting the burner nozzle tips in unison the fireball can be physically raised or lowered within the furnace so as to increase or decrease the heat absorption by the furnace waterwalls thereby raising or lowering the temperature of the combustion products leaving the furnace proper to pass over the superheater and reheater surface. As the temperature of the combustion products entering the boiler section changes, the temperature of the steam generated in the heat absorption surface disposed therein changes proportionally. Such as method of steam temperature control is shown in U.S. Pat. No. 2,363,875 to Kreisinger et al, issued Nov. 28, 1944.

A typical coal-air admission assembly or burner employed heretofore on a tangentially-fired furnace comprises a coal delivery pipe, often termed a coal nozzle, through which pulverized coal entrained in a primary air stream is delivered to the furnace, an air conduit surrounding the coal delivery pipe through which additional air is delivered to the furnace, and a nozzle tip pivotally mounted to the coal delivery pipe so as to be tiltable in a vertical plane whereby the pulverized coal-air stream being delivered to the furnace through the coal delivery pipe and the additional air passing through the air conduit can be directly discharged into the furnace as dictated by steam temperature requirements.

A typical prior art burner nozzle tip, such as that shown in U.S. Pat. No. 2,895,435 to Bogot et al, issued July 21, 1959, was formed of a steel open-ended inner shell defining a flow passageway through which the pulverized coal-air stream from the coal delivery pipe is delivered into the furnace and a steel open-ended outer shell spaced from and surrounding the inner shell so as to define an annular duct through which the air leaving the air conduit is directed into the furnace. Additionally, one or more steel or stainless steel baffles, termed splitter plates, are typically disposed within the inner shell of the nozzle tip and aligned parallel to the longitudinal axis thereof, to impart additional directional force to the coal-air stream discharging through the inner shell and to ensure a uniform distribution of the coal-air stream particularly when the nozzle tip is tilted away from the horizontal.

A major problem heretofore encountered in using such nozzle tips has been the rapid wear of the steel or stainless steel splitter plates due to extreme erosion caused by the impingement of coal particles entrained in the high velocity air stream passing from the coal delivery pipe. As these splitter plates wear away, they lose their ability to adequately direct the pulverized coal-air stream into the furnace, thus detracting from the effectiveness of the nozzle tip in controlling steam temperature.

More importantly, as the splitter plates wear away, more and more coal particles bypass the plates and impinge upon the walls of the inner shell when the nozzle tips are tilted away from the horizontal resulting in increased and more rapid wear of the shell itself. Consequently, these prior art nozzle tips must be replaced more often than preferred and more frequently than would be necessary if the inner shell of the nozzle tips had not been exposed to the erosive effect of the impinging coal particles.

SUMMARY OF THE INVENTION

Accordingly, it is an object of the present invention to provide an improved nozzle tip which would have a significantly longer lifetime in the extremely erosive environment associated with the pulverized coal firing.

In accordance with the present invention, an improved nozzle tip having one or more splitter plates disposed therein is characterized in that the splitter plates comprise a first plate of highly abrasion resistant material disposed at the inlet end of the nozzle tip, and a second plate of highly heat resistant material disposed at the outlet end of the nozzle tip. The first plate of highly abrasion resistant material has its leading edge, which is preferably rounded, disposed along the inlet end of the nozzle tip and extends a substantial distance through the inner shell of the nozzle tip along a line parallel to the longitudinal axis thereof. The highly abrasion resistant plate terminates within the nozzle tip with its trailing edge set back from the discharge end of the nozzle tip. The second plate of highly heat resistant material is disposed within the inner shell so as to abut the trailing edge of the highly abrasion resistant plate and extend therefrom towards the discharge end of the nozzle tip along a line parallel to the longitudinal axis thereof.

BRIEF DESCRIPTION OF THE PREFERRED EMBODIMENT

Figure 1:
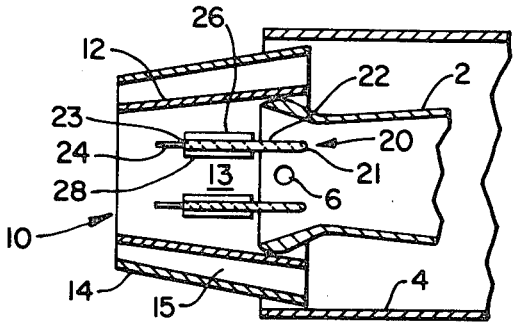
FIG. 1 is a cross-sectional side elevation view showing the nozzle tip of the present invention incorporated into a typical fuel-air admission assembly employed on a pulverized coal-fired furnace utilizing tangential firing.

Referring now to the drawing, there is depicted an improved nozzle tip 10 constructed in accordance with the present invention. In FIG. 1, the burner nozzle tip 10 is shown incorporated into a fuel-air admission assembly, i.e., burner, of the type typically employed on a pulverized coal-fired furnace utilizing tangential firing, although variations of the improved nozzle tip of the present invention might readily be incorporated in other burner configurations without departing from the spirit and scope of the present invention.

As shown in the figures, burner nozzle tip 10 comprises an open-ended inner shell 12 surrounded by an open-ended outer shell 14 which is spaced away from the inner shell 12 by a plurality of ribs 16 disposed therebetween. The ribs 16 are welded to the inner surface of the outer shell 14 and the outer surface of the inner shell 12 thereby forming the structural framework of the nozzle tip 10. As shown in FIG. 1, the nozzle tip 10 is recessed into the air delivery conduit 4 of the fuel-air admission assembly and pivotally mounted to the discharge end of the coal delivery pipe 2 so as to be tiltable about an axis 6 transverse to the longitudinal axis of the coal delivery pipe 2.

Functionally, the burner nozzle tip 10 serves to provide a means for imparting a directional force to the pulverized coal discharging from the coal delivery pipe 2 and to the air being delivered to the furnace through air conduit 4. The inner shell 12 is adapted to fit around the dischage end of the coal delivery pipe 2 and defines a duct which serves as a flow passageway through which the pulverized coal-air stream discharging from the coal delivery pipe 2 traverses before entering the furnace. Additionally, an annular duct 15 is defined in the space between the inner shell 12 and the outer shell 14 which serves as a flow passageway through which the additional air discharging from air conduit 4 must traverse before entering the furnace.

As mentioned hereinbefore, the nozzle tip 10 is tiltable about an axis transverse to the longitudinal axis of the coal delivery pipe in order that the position of the fireball within the furnace may be changed to effect steam temperature control. In its normal position, the nozzle tip 10 is positioned with its longitudinal axis aligned with the longitudinal axis of the coal delivery pipe 2, which is generally horizontally disposed. In order to raise the fireball within the furnace, nozzle tip 10 would be rotated about axis 6 so as to tilt upward, thereby causing both the pulverized coal-air stream traversing chamber 13 and the air traversing duct 15 to be directed upward. Similarly, if the fireball is to be lowered within the furnace, nozzle tip 10 would be rotated about axis 6 so as to tilt downward, thereby causing both the pulverized coal-air stream traversing chamber 13 and the air traversing duct 15 to be directed downward.

It is well-known that the ability of the nozzle tip 10 to effectively deflect the pulverized coal-air stream traversing chamber 13 upward or downward when the nozzle tip 10 is tilted from the horizontal is greatly enhanced by positioning at least one, and preferably two or three, baffles, termed splitter plates, within the inner shell so as to divide it into a plurality of flow passages. These splitter plates also ensure that a uniform coal distribution is obtained over the height of the nozzle tip even when the nozzle tip is tilted away from the horizontal. Additionally, the uppermost and lowermost splitter plates serve to protect the inner surface of the inner shell 12 from impinging coal particles when the nozzle tip is tilted.

It has been the practice heretofore to form the splitter plates, as well as the nozzle tip structure itself, of steel or stainless steel because of the heat resistant ability of steel which permits the nozzle tip to survive in an environment where it is continuously disposed to direct radiation of heat from the fireball, However, these prior art splitter plates have been subject to severe erosion caused by coal particles impinging upon them. When the splitter plates become too worn, the effectiveness of tilting the nozzle tips is lost and the inner shell itself becomes exposed to more and more coal particles. Consequently, the furnace must be periodically brought off line in order to replace the nozzle tips.

The typical wear pattern associated with the steel splitter plates has been the thinning of the material developing a V-shaped notch extending back from the leading edge of the plate, i.e., the edge of the plate exposed to the coal particles discharging from the coal delivery pipe. The apex of the V continuously progresses back along the plate toward the discharge end of the nozzle tip, i.e., toward the trialing edge of the plate, as the disc simultaneously deepens. Eventually, a hole is cut through the plate completely destroying its effectiveness.

Figure 2:
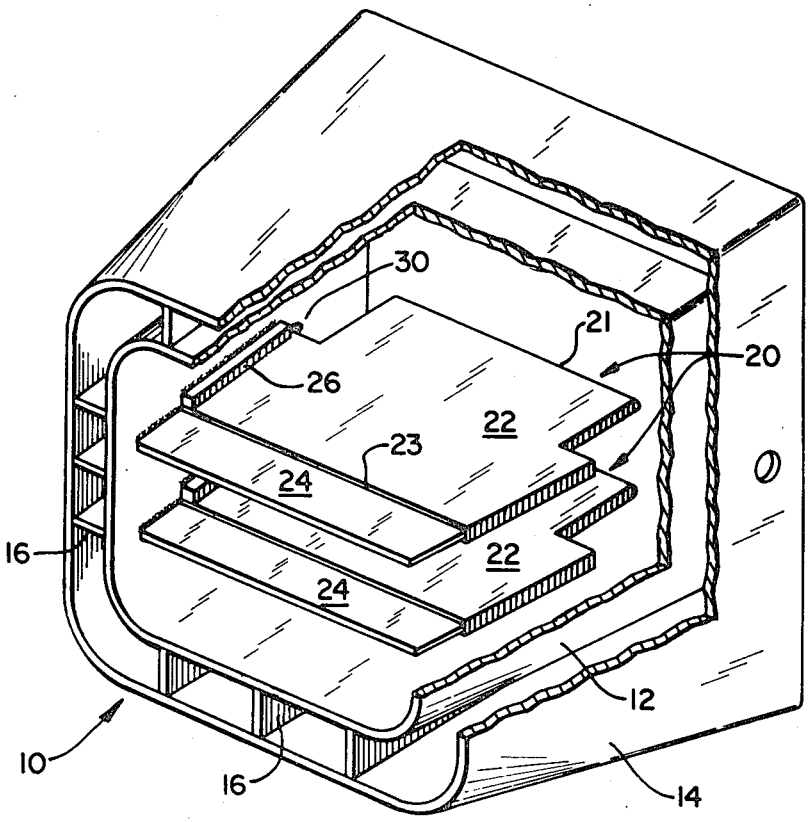
FIG. 2 is a perspective view, partly in section, of the improved nozzle tip of the present invention.

In accordance with the present invention, an improved nozzle tip 10 is provided having one or more splitter plates 20 disposed therein, the spliter place 20 having a first portion 22 of highly abrasion resistant material, such as a highly abrasion resistant ceramic, disposed at the inlet end of the nozzle tip 10 and a second portion 24 of highly heat resistant material disposed at the outlet end of the nozzle tip. In the best mode embodiment presently contemplated, as shown in FIGS. 1 and 2, the first portion of highly abrasion resistant material of splitter plate 20 comprises a plate 22 of highly abrasion resistant material having its leading edge 21 disposed along the inlet end of the nozzle tip and extending therethrough a substantial distance along a line parallel to the longitudinal axis thereof. The highly abrasion resistant plates 22 terminate within the nozzle tip 10 with its trailing edge 23 set back from the discharge end of the tip. The second portion of the splitter plate 20 comprises a plate 24 of highly heat resistant material disposed within the inner shell 10 so as to abut the trailing edge 23 of the highly abrasion resistant plates 22 and extend therefrom toward the discharge end of the nozzle tip 10 along the line parallel to the longitudinal axis of the inner shell 12.

In accordance with the present invention, the highly abrasion resistant plates 22 are held in position within the inner shell by a plurality of paired rails 26 and 28 welded to the inner surface of the inner shell 12. The upper rail 26 of each pair is disposed along the top surface of the lateral edge of the plates 22, with the lower rail 28 of each pair being disposed along the bottom surface of the lateral edge of the plates 22. Thus, a channel is formed between the paired rails 26 and 28 into which the lateral edge of the plates 22 is slidably inserted. Once inserted into the channels, means are provided to hold the plates 22 therein, such as a weld bead 30 deposited on the inner surface of the inner shell 12 at the aft end of each channel. This enables the nozzle tip 10 to be tilted uwpard without fear of the plates 22 falling out of their channels.

The second plate 24 of highly heat resistant material is welded at its lateral edges to the inner surface of the inner shell 12 and in this manner serves to prevent the highly abrasion resistant plate 20 from falling forward into the furnace when the nozzle tip 10 is tilted downward.

In the preferred embodiment of the present invention, the highly temperature resistant portion 24 of the splitter plate 20 is formed of a stainless steel plate and the highly abrasion resistant portion 22 of the splitter plate 20 is formed of a silicon carbide plate. Additionally, it is preferred to round the leading edge 21 of the silicon carbide plate 22 in order to provide a streamline surface to intercept the pulverized coal particles dicharging from the coal delivery pipe 2 and to minimize the amount of surface subject to a direct perpendicular impingement by the coal particles.

Accordingly, the present invention provides an improved nozzle tip 10 which possesses a longer useful lifetime than prior art nozzle tips in the high temperature and extremely erosive environment associated with pulverized coal firing. The improvement is characterized by a splitter plate 20 comprised of a first plate 22 of highly abrasion resistant material disposed within the inner shell 12 of the nozzle tip 10 with its leading edge 21 along the inlet end of the nozzle tip 10 and a second plate 24 of highly heat resistant material also disposed within the air shell 12 so as to abut the trailing edge 23 of the highly abrasion resistant plate 20 and to extend therefrom towards the discharge end of the nozzle tip 10.

The life of the splitter plate 20 is prolonged by the fact that the first plate 22 of highly abrasion resistant material on the leading edge 21 thereof are exposed to and bear the erosive impact of the coal particles. This portion of the plate being of highly abrasion resistant material survives much longer than the prior art stainless steel splitter plates.

The second plate 24 of highly heat resistant material serves not only to prevent the first plate 20 from falling forward out of its channel into the furnace when the nozzle tip 10 is tilted downward, but also, and more importantly, serves to shield the first plate 20 from the direct radiation of the fireball. Thus, the first plate 20 can be made of a material having somewhat less heat resistance than the stainless steel plate 24 but having a much higher abrasion resistance.

Experimental tests have shown that under similar conditions of temperature exposure and coal flow, a nozzle tip utilizing the steel plates of the prior art will after one year show significant wear with V-shaped cuts of over four inches in length commonly present. However, after a one-year period in the same environment, an experimental embodiment of the improved nozzle tip of the present invention was in excellent condition with the splitter plate showing no signs of appreciable wear and the leading edges thereof still being rounded as they were when first installed.

While the preferred embodiment of the present invention has been illustrated and described when incorporated into a fuel-air admission assembly of the type typically employed on a tangentially-fired unit, it is to be understood that the invention should not be limited thereto. The nozzle tip of the present invention could be readily modified by those skilled in the art to be applied within its spirit and scope of the present invention to any number of burner configurations wherein pulverized coal or other abrasive solids are combusted.

I claim:

1. A nozzle tip for a burner on a pulverized coal-fired furnace, said nozzle tip of the type having: an open-ended outer shell spaced from and surrounding said inner shell, so as to define an annualar flow passageway therebetween through which additional air is directed into the furnace; and a splitter plate positioned within said inner shell along a line parallel to the longitudinal axis thereof so as to divide the inner shell into a plurality of flow passages, wherein said splitter plate comprises a first portion of abrasion resistant material disposed within said inner shell with its leading edge at the inlet end of the nozzle tip and extending a substantial distance into said inner shell along a line parallel to the longitudinal axis thereof; and a second portion of heat resistant material disposed within said inner shell so as to abut the trailing edge of said abrasion resistant plate and extend therefrom toward the discharge end of said nozzle tip along a line parallel to the longitudinal axis of said inner shell.

2. A nozzle tip as recited in claim 1 wherein said abrasion resistant plate is formed of ceramic.

3. A nozzle tip as recited in claim 2 wherein said abrasion resistant plate is formed of silicon carbide.

4. A nozzle tip as recited in claim 1, 2, or 3 wherein said heat resistant plate is formed of stainless steel.

5. A nozzle tip as recited in claims 1, 2, or 3 further comprising:

a. a plurality of paired retaining rails welded to the inner surface of said inner shell, one rail of each pair disposed along the top surface of the lateral edges of said abrasion resistant plate and the other of each pair disposed along the bottom surface of the lateral edges of said abrasion resistant plate, thereby forming channels along the inner surface of said inner shell in which said abrasion resistant plate is retained; and b. a means for retaining the abrasion resistant plate within said channels when the nozzle tip is tilted away from the horizontal.

6. A nozzle tip as recited in claim 5 wherein said heat resistant plate comprises a stainless steel plate welded at its lateral edges to the inner surface of said inner shell.

7. A nozzle tip as recited in claim 1, 2, or 3 wherein the leading edge of said abrasion resistant plate is rounded.

8. A nozzle tip as recited in claim 5 wherein the leading edge of said abrasion resistant plate is rounded.

* * * * *

UNITED STATES PATENT AND TRADEMARK OFFICE

CERTIFICATE OF CORRECTION

PATENT NO. : 4,356,975

DATED : November 2, 1982

INVENTOR(S) : Roman Chadshay

It is certified that error appears in the above—identified patent and that said Letters Patent is hereby corrected as shown below:

Column 6, line 8, in Claim 1, insert after "having:" the following:

-- an open-ended inner shell defining a flow passageway through which a mixture of pulverized coal and air is directed into the furnace; --

Signed and Sealed this

*Eleventh* Day of *October 1983*

[SEAL]

*Attest:*

GERALD J. MOSSINGHOFF

*Attesting Officer*

*Commissioner of Patents and Trademarks*